US007444103B2

(12) United States Patent
Okabe et al.

(10) Patent No.: US 7,444,103 B2
(45) Date of Patent: Oct. 28, 2008

(54) IMAGE-FORMING DEVICE AND DEVELOPING UNIT USED THEREIN

(75) Inventors: Yasushi Okabe, Nagoya (JP); Naoya Kamimura, Nagoya (JP); Yoshito Takakuwa, Aisai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 133 days.

(21) Appl. No.: 11/501,687

(22) Filed: Aug. 10, 2006

(65) Prior Publication Data

US 2007/0036591 A1 Feb. 15, 2007

(30) Foreign Application Priority Data

Aug. 10, 2005 (JP) ..... 2005-232158

(51) Int. Cl.
*G03G 15/01* (2006.01)
*G03G 15/04* (2006.01)
*G03G 15/08* (2006.01)

(52) U.S. Cl. ..... 399/228; 399/119; 399/279

(58) Field of Classification Search ..... 399/113, 399/119, 228, 279
See application file for complete search history.

(56) References Cited

U.S. PATENT DOCUMENTS 4,339,196 A * 7/1982 Beck et al. ..... 399/119
4,583,832 A * 4/1986 Kasamura et al. ..... 399/119
4,814,816 A * 3/1989 Idenawa ..... 399/279 X
6,094,554 A * 7/2000 Ichikawa et al. ..... 399/279
6,546,218 B2 4/2003 Uchida
6,647,233 B2 * 11/2003 Hiroki ..... 399/228
6,751,428 B2 6/2004 Okabe
2004/0265000 A1 12/2004 Okabe
2005/0069347 A1 3/2005 Okabe

FOREIGN PATENT DOCUMENTS

JP 7234552 9/1995
JP 11-133730 5/1999
JP 2001-343809 12/2001
JP 2003-084647 3/2003
JP 2005-037680 2/2005
JP 2005-107189 4/2005

* cited by examiner

*Primary Examiner*—Sandra L Brase
(74) *Attorney, Agent, or Firm*—Banner & Witcoff, Ltd

(57) ABSTRACT

In an image-forming device including an image-carrying member, a developer-carrying member, and a casing having an inner space in which developer is accommodated and the developer-carrying member is supported, both a pushing force and a separating force are not applied to the casing so that the thickness of the casing does not need to be increased. The casing is formed with a pair of first protruding parts each having an end that protrudes outward along the axial direction of the developer-carrying member, and a pair of second protruding parts each having an end that protrudes farther outward than the corresponding end of the first protruding part. The first protruding parts serve as operating parts operated by a pressing member, and the second protruding parts serve as operating parts operated by a separating member.

10 Claims, 8 Drawing Sheets

IMAGE-FORMING DEVICE AND DEVELOPING UNIT USED THEREIN

CROSS REFERENCE TO RELATED APPLICATIONS

This application claims priority from Japanese Patent Application No. 2005-232158 filed Aug. 10, 2005. The entire content of each of these priority applications is incorporated herein by reference.

TECHNICAL FIELD

The present invention relates to an electrophotographic image-forming device, such as a laser printer, a photocopier, or a facsimile device. The present invention also relates to a developing unit provided in the image-forming device.

BACKGROUND

Laser printers described in Japanese Patent Application Publication Nos. HEI-11-133730 and 2005-37680 and also U.S. Pat. No. 6,751,428 are generally configured of a frame including a photosensitive drum, and a developing unit, commonly called a developer cartridge that is detachably mounted in the frame. The developer cartridge also includes a developing roller, and a case for accommodating developer. The case has an elongated shape that extends along the axial direction of the developing roller. The developing roller is positioned at a side surface of the case that extends along the axial direction of the developing roller. This type of laser printer also includes a pressing member for pressing the case so that the developing roller is pressed against the photosensitive drum in the frame, and a separating member for moving the case so that the developing roller separates from the photosensitive drum. This type of laser printer has been configured to apply both a pushing force with the pushing member for pushing the case of the developing unit and a separating force with the separating member for displacing the developing unit in a direction away from the photosensitive drum to single points on the case.

However, when these forces are applied to the same points on the developer case, it is necessary to reinforce the part of the case to which the force is applied and the vicinity thereof. To avoid this problem, U.S. Pat. No. 6,546,218 proposes a laser printer that divides the load so that the force of pushing the case with a pushing member and the force for separating the case with a separating member are not applied to the same point.

However, this type of load separating laser printer is configured so that the region near the longitudinal center of the developer case is pushed. Since there is potential for bending in the case with this construction, it is necessary to reinforce the laser printer by increasing the thickness of the case and the like.

SUMMARY

In view of the foregoing, it is an object of the present invention to provide an image-forming device that does not apply both a pushing force and a separating force to the case of a developing unit and that does not require the thickness of the case to be increased.

It is another object of the present invention to provide a developing unit employed in the image-forming device.

To achieve the above and other objects, there is provided an image-forming device that includes an image-carrying member having a surface on which electrostatic latent images are formable; a developer-carrying member; a casing having an inner space configured to accommodate developer, a pressing member and a separating member. The developer-carrying member is configured to supply developer to the image-carrying member to develop the electrostatic latent image into a visible image. The developer-carrying member is supported in the casing and disposed in a position where developer accommodated in the inner space of the casing is conveyable to the image-carrying member. The pressing member is configured to press the casing in a direction causing the developer-carrying member to press against the image-carrying member. The separating member is configured to displace the casing in a direction that separates the developer-carrying member from the image-carrying member. The casing includes a pair of first protruding parts each having an end that protrudes outward along the axial direction of the developer-carrying member; and a pair of second protruding parts each having an end that protrudes farther outward than the corresponding end of the first protruding part, such that the first protruding parts serve as operating parts operated by the pressing member, and the second protruding parts serve as operating parts operated by the separating member.

It is desirable that the second protruding parts and the operating parts are offset from each other in this image-forming device. Accordingly, forces in reverse directions are not repeatedly applied to the same region. Hence, unlike conventional developing units, this image-forming device makes it possible to construct a developing unit, without reinforcing parts at which the second protruding parts and operating parts are provided.

According to another aspect of the invention, there is provided a developing unit that includes a developer-carrying member configured to supply developer to an image-carrying member on which electrostatic latent images are formable to develop the electrostatic latent image into a visible image; and a casing having an inner space configured to accommodate developer. The developer-carrying member is supported in the casing and disposed in a position where developer accommodated in the inner space of the casing is conveyable to the image-carrying member. The casing includes a pair of first protruding parts each having an end that protrudes outward along the axial direction of the developer-carrying member; and a pair of second protruding parts each having an end that protrudes farther outward than the corresponding end of the first protruding part, such that the first protruding parts serve as operating parts operated by the pressing member, and the second protruding parts serve as operating parts operated by the separating member.

DETAILED DESCRIPTION

Figure 1:
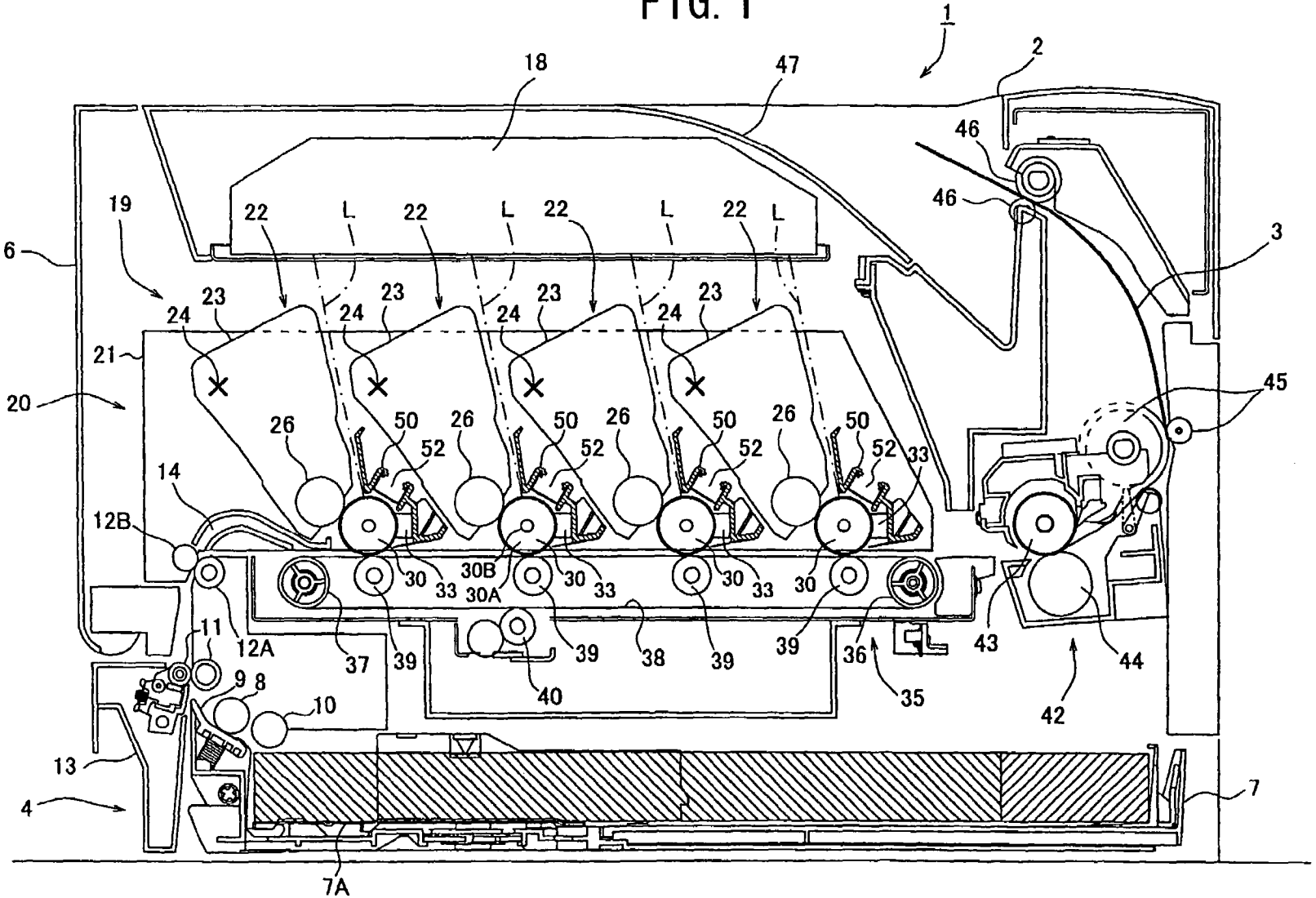
FIG. 1 is a side cross-sectional view showing the general structure of a laser printer 1 serving as the image-forming device in the preferred embodiment.

An image forming device according to some aspects of the invention will be described while referring to the accompanying drawings wherein like parts and components are designated by the same reference numerals to avoid duplicating description.

Figure 2:
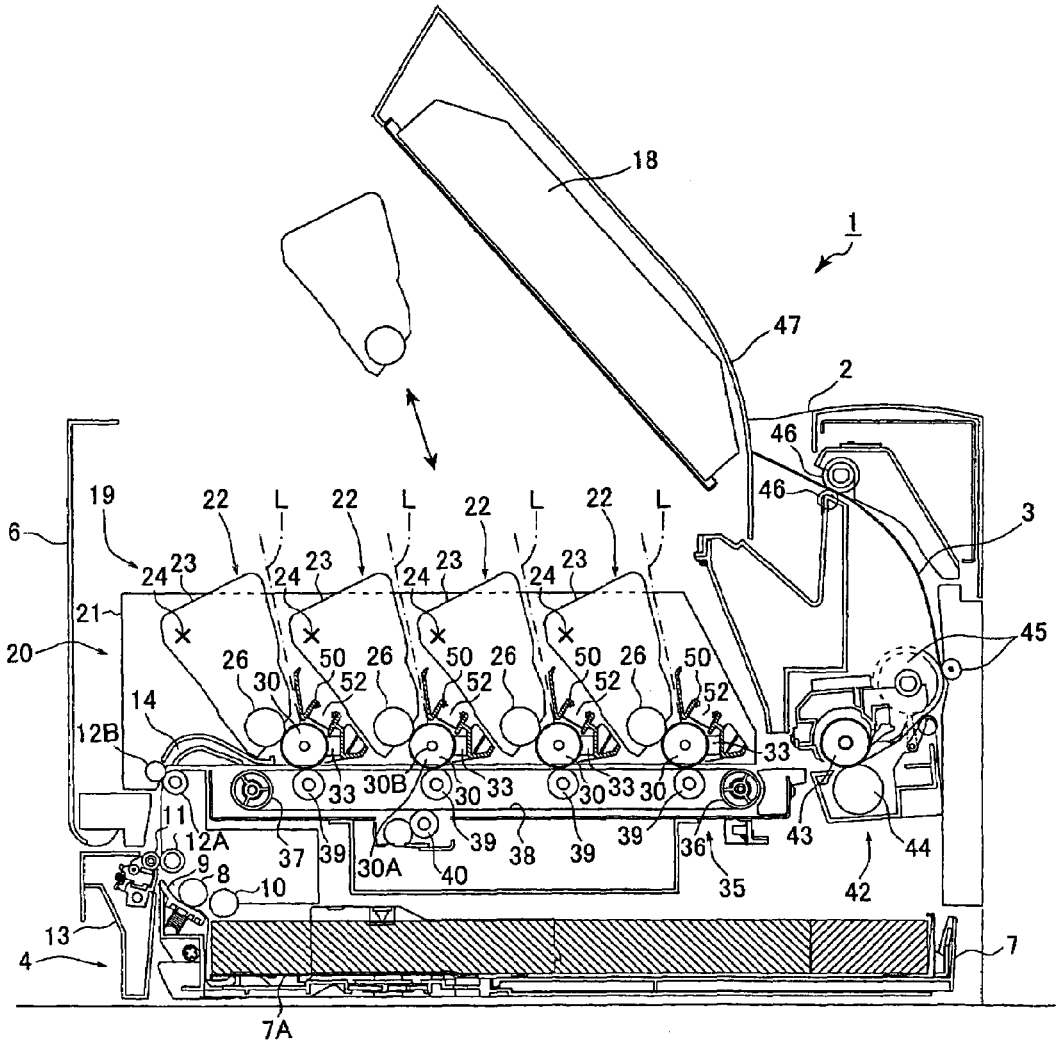
FIG. 2 is a cross-sectional view illustrating an operation for removing a frame 21 from the laser printer 1 in FIG. 1.

FIG. 1 is a side cross-sectional view showing the general structure of a laser printer 1 serving as the image-forming device. FIG. 2 is a side cross-sectional view illustrating an operation for removing an image-forming unit 20 from the laser printer 1.

As shown in FIG. 1, the laser printer 1 is a direct tandem type color laser printer having four photosensitive drums 30 corresponding to the colors black, cyan, magenta, and yellow. The laser printer 1 includes a main casing 2 and, within the main casing 2, a feeding unit 4 for feeding sheets of a paper 3, the image-forming unit 20 for forming images on the paper 3 supplied from the feeding unit 4, and a paper-conveying unit 35 for conveying the paper 3 along the image-forming unit 20. In the following description, left and right sides and directions will conform to the left and right sides and directions in FIG. 1.

A top cover 6 capable of opening and closing over the main casing 2 is provided on the top of the main casing 2. In a closed position shown in FIG. 1, the top cover 6 covers the top surface of the main casing 2 in a substantially horizontal orientation. From the closed position, the top cover 6 can be pivotally rotated about hinges (not shown) provided in the main casing 2 to an open position by moving the left end of the top cover 6 upward. When the top cover 6 is in the open position, the image-forming unit 20 described later can be pulled out of the main casing 2 as indicated by an arrow in FIG. 2. When the top cover 6 is in the closed position, the top cover 6 is nearly flush with the top surface of the main casing 2, as shown in FIG. 1.

The feeding unit 4 includes a paper tray 7 that is detachably mounted in a lower section of the main casing 2, a feeding roller 8 and a separating pad 9 disposed above a left end of the paper tray 7, a pickup roller 10 disposed on the right of the feeding roller 8, a pair of paper dust rollers 11 disposed above and to the left of the feeding roller 8, and a pair of registration rollers 12A and 12B disposed above the paper dust roller 11.

The paper tray 7 is formed in a box shape having an open top for loading sheets of paper 3 and a depth capable of accommodating a fixed number of sheets of paper 3 in a stacked state. A left wall 13 is provided on the left end of the paper tray 7 and on the left surface of the main casing 2 below the top cover 6. By pulling the left wall 13 leftward, it is possible to remove the paper tray 7 from the left side of the main casing 2 in a horizontal motion. A paper pressing plate 7A is provided in the bottom surface of the paper tray 7 for supporting the paper 3 in a stacked state. The paper pressing plate 7A is rotatably supported on the right end thereof, while the left end is urged upward by a spring (not shown). With this configuration, the left edge of the paper 3 stacked in the paper tray 7 is constantly urged upward.

The urging force of the paper pressing plate 7A presses the topmost sheet of paper 3 in the paper tray 7 toward the pickup roller 10. During a printing operation, the pickup roller 10 rotates to begin conveying the topmost sheet toward a position between the feeding roller 8 and the separating pad 9. As the sheet of paper 3 becomes interposed between the feeding roller 8 and the separating pad 9, the rotating feeding roller 8 separates and conveys the paper 3 one sheet at a time. The paper dust rollers 11 receive and convey the sheet of paper 3 toward the registration rollers 12A and 12B while removing paper dust from the sheet.

The registration rollers 12A and 12B are a drive roller and a follow roller, respectively. After adjusting the registration of the paper 3, the registration rollers 12A and 12B convey the paper 3 along a paper-conveying path 14 and onto a conveying belt 38 in the paper-conveying unit 35 described later. The paper-conveying path 14 is an arc-shaped path formed in a frame 21 of the image-forming unit 20 described later.

A scanning unit 18 is disposed in the topmost section of the main casing 2. The scanning unit 18 irradiates four laser beams L based on prescribed image data for each color over surfaces of the corresponding photosensitive drums 30 described later in a high-speed scan. The scanning unit 18 emits the four laser beams L diagonally downward and to the right through the bottom surface of the scanning unit 18. The laser beams L form parallel optical paths spaced at prescribed intervals in the left-to-right direction.

An accommodating section 19 is formed inside the main casing 2 below the scanning unit 18 for accommodating the image-forming unit 20 so that the image-forming unit 20 can be mounted in and removed from the accommodating section 19 through the upper open portion of the main casing 2. The image-forming unit 20 includes the frame 21, mentioned above, that functions to retain the photosensitive drums 30, Scorotron chargers 50, developing units 22, and cleaning brushes 33 provided for each color.

The four developing units 22 are detachably mounted in the frame 21 and correspond to the colors black, cyan, magenta, and yellow, respectively. Each developing unit 22 includes a case 23 having a box shape open on the bottom side, and is formed with a toner-accommodating chamber 24 in the upper section of the case 23 that is filled with the corresponding color of toner. An agitator (not shown) is disposed inside the toner-accommodating chamber 24. When the driving force of a motor (not shown) is inputted, the agitator rotates and stirs toner inside the toner-accommodating chamber 24. A developing roller 26 is disposed on the lower side of the toner-accommodating chamber 24.

The developing roller 26 is rotatably supported in the case 23 of the developing unit 22 and is positioned in contact with the corresponding photosensitive drum 30 when the developing unit 22 is mounted in the frame 21. The developing roller 26 includes a metal roller shaft that is covered with a roller member formed of an electrically conductive urethane rubber or silicon rubber containing fine carbon particles or the like. The surface of the roller member is also coated with a urethane rubber or silicon rubber containing fluorine. During a developing operation, a developing bias is applied to the developing roller 26. Further, a motor (not shown) inputs a driving force for rotating the developing roller 26.

Toner discharged from the toner-accommodating chamber 24 is supplied to the developing roller 26 by a supply roller (not shown) provided in the toner accommodating chamber 24. At this time, the toner is positively tribocharged between the supply roller and the developing roller 26. A thickness-regulating blade (not shown) disposed in the toner-accommodating chamber 24 regulates the toner supplied on the developing roller 26 to maintain a thin layer of uniform thickness on the surface of the developing roller 26.

The photosensitive drum 30 is formed in a cylindrical shape and includes a main roller body 30A and a metal roller shaft 30B. The outermost surface of the main roller body 30A is formed of a positive charging photosensitive layer such as polycarbonate. The metal roller shaft 30B extends in the longitudinal direction of the main roller body 30A through the axial center thereof. By rotatably supporting the metal roller shaft 30B in the frame 21, the photosensitive drum 30 can rotate with the metal roller shaft 30B. Further, a motor (not shown) inputs a driving force for rotating the photosensitive drum 30.

Each charger 50 includes a charging wire 52 and is disposed in opposition to the corresponding photosensitive drum 30 at a prescribed distance so as not to contact the photosensitive drum 30 and so the charging wire 52 is positioned diagonally above and rightward of the photosensitive drum 30. The charging wire 52 generates a corona discharge for charging the surface of the photosensitive drum 30 with a uniform positive polarity.

Each cleaning brush 33 opposes and contacts the corresponding photosensitive drum 30 on the right side thereof.

The paper-conveying unit 35 is disposed below the image-forming unit 20 when the image-forming unit 20 is mounted in the accommodating section 19. The paper-conveying unit 35 includes a pair of belt support rollers 36 and 37 disposed on a right side and left side, respectively, and arranged parallel to each other, and a conveying belt 38 looped around the belt support rollers 36 and 37. When the belt support roller 36 on the right side is driven to rotate by the driving force of a motor (not shown), the conveying belt 38 moves in a circuit around the belt support rollers 36 and 37. Four transfer rollers 39 are disposed inside the conveying belt 38 at fixed intervals in the left-to-right direction. At these positions, the transfer rollers 39 oppose the respective photosensitive drums 30 with the conveying belt 38 interposed therebetween. A cleaning roller 40 is also disposed on the bottom of the conveying belt 38 for cleaning residual toner from the surface of the conveying belt 38. A sheet of paper 3 conveyed from the registration rollers 12A and 12B along the paper-conveying path 14 contacts the top surface of the conveying belt 38 near the left edge thereof. At this time, the conveying belt 38 moving circuitously electrostatically attracts the sheet to the surface thereof and conveys the sheet rightward.

As the photosensitive drum 30 rotates, the charger 50 charges the surface of the photosensitive drum 30 with a uniform positive polarity. Subsequently, the scanning unit 18 irradiates the laser beam L in a high speed scan over the surface of the photosensitive drum 30 to form an electrostatic latent image on the photosensitive drum 30 corresponding to an image that is to be formed on the paper 3.

Next, the positively charged toner carried on the surface of the developing roller 26 comes into contact with the photosensitive drum 30 as the developing roller 26 rotates. At this time, the toner is supplied to the electrostatic latent image formed on the surface of the photosensitive drum 30, that is, the regions on the surface of the positively charged photosensitive drum 30 that were exposed to the laser beam L and, therefore, have a lower potential. The toner supplied to the photosensitive drum 30 develops the electrostatic latent image into a visible image according to a reverse development process so that a toner image is carried on the surface of the photosensitive drum 30.

As a sheet of paper 3 conveyed on the conveying belt 38 passes through transfer positions between each of the photosensitive drums 30 and the corresponding transfer roller 39, the toner image carried on the surface of the photosensitive drum 30 is transferred onto the paper 3 by a transfer bias applied to the transfer roller 39. After the toner image is transferred onto the paper 3, the paper 3 is conveyed to a fixing unit 42.

The fixing unit 42 is disposed in the main casing 2 to the right of the paper-conveying unit 35. The fixing unit 42 includes a heating roller 43 and a pressure roller 44 disposed in confrontation with each other for fixing the toner image transferred onto the paper 3 to the surface of the paper 3 with heat. After the toner image has been fixed to the paper 3, conveying rollers disposed diagonally above and rightward of the fixing unit 42 convey the paper 3 toward discharge rollers 46 disposed in the top section of the main casing 2. A discharge tray 47 that is substantially level on the left side and slopes downward toward the right side is provided on the top surface of the main casing 2. After the image-forming process described above is completed for each sheet of paper 3, the discharge rollers 46 discharge the paper 3 onto the discharge tray 47 where the sheets accumulate in a stack.

Next, the developing unit 22 having a structure that is a feature in the laser printer 1 of the preferred embodiment will be described.

Figure 3B:
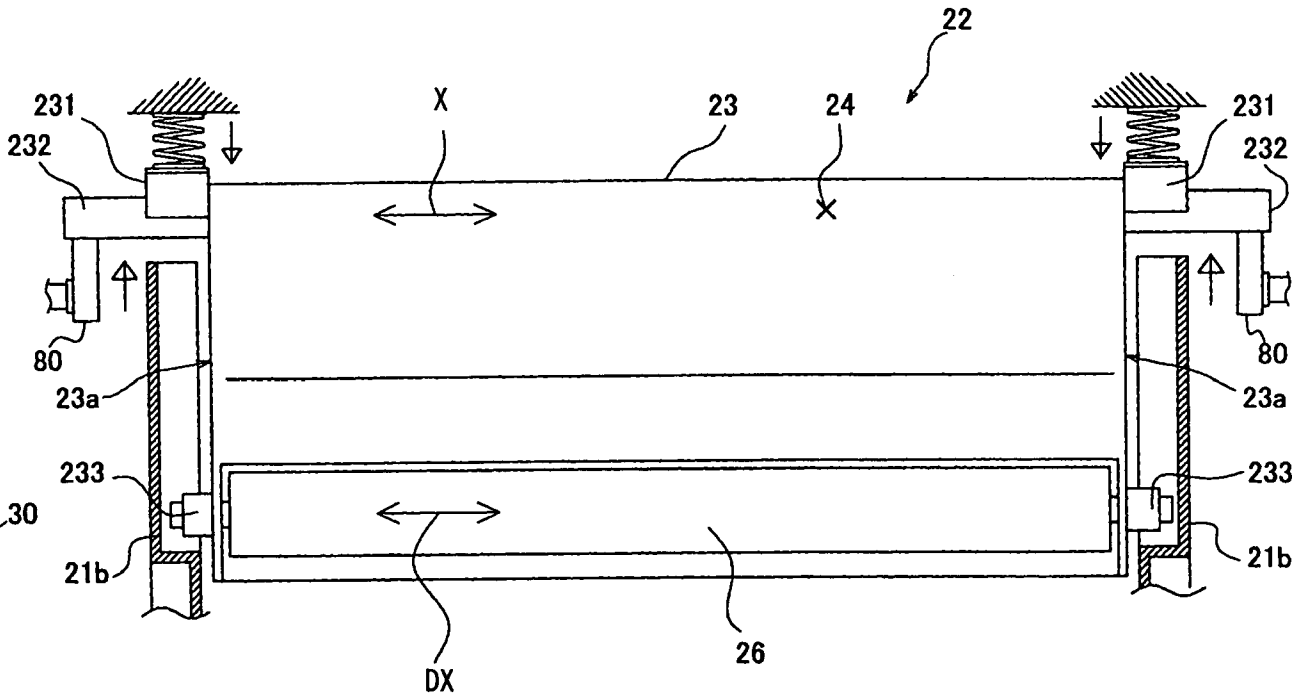
FIG. 3A is a side view and FIG. 3B a front view of a developing unit according to the preferred embodiment.
Figure 3A:
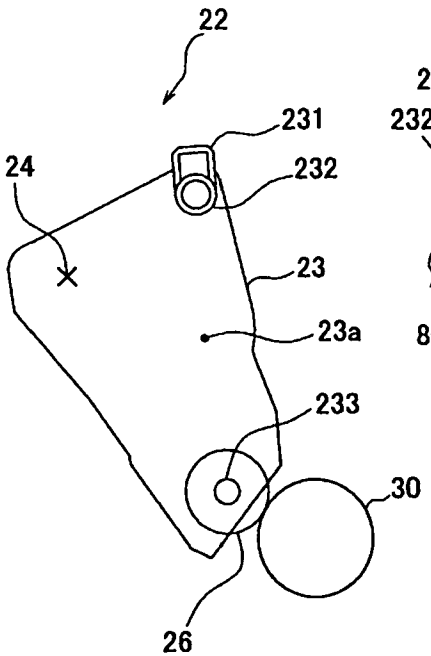
Figure 4:
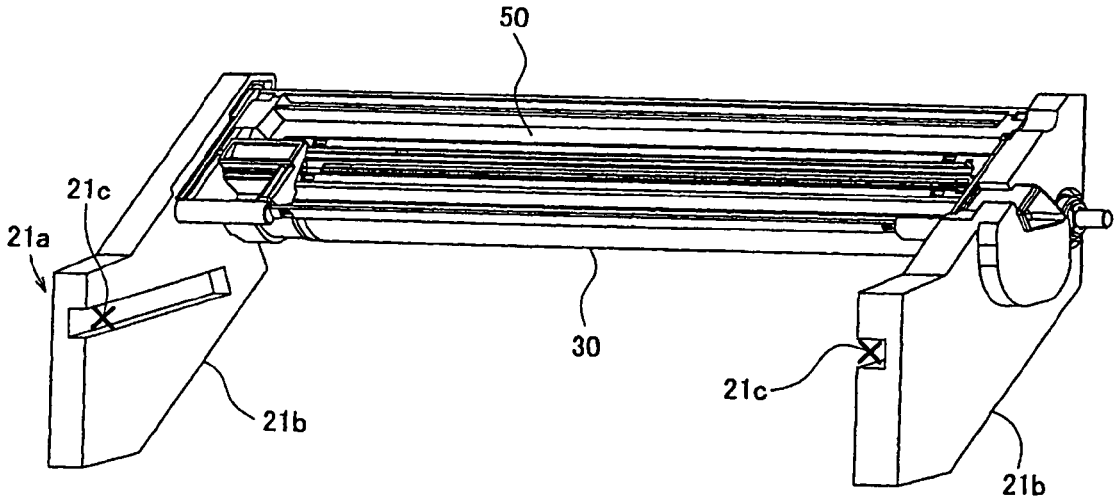
FIG. 4 is a perspective view of a block 21*a* constituting part of the frame 21 according to the preferred embodiment.
Figure 5:
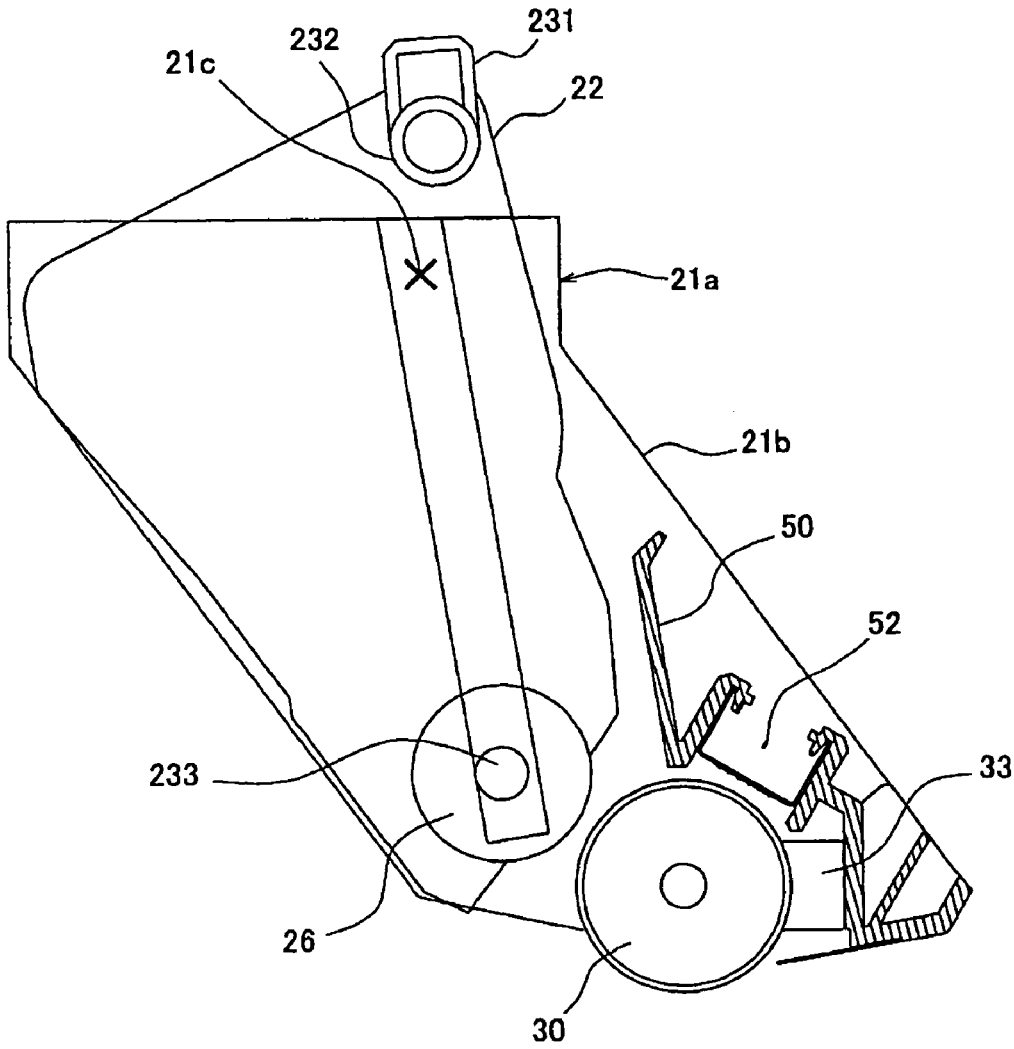
FIG. 5 is a side view of the block 21*a* illustrating an operation for mounting a developing unit 22 on the block 21*a;*
Figure 6:
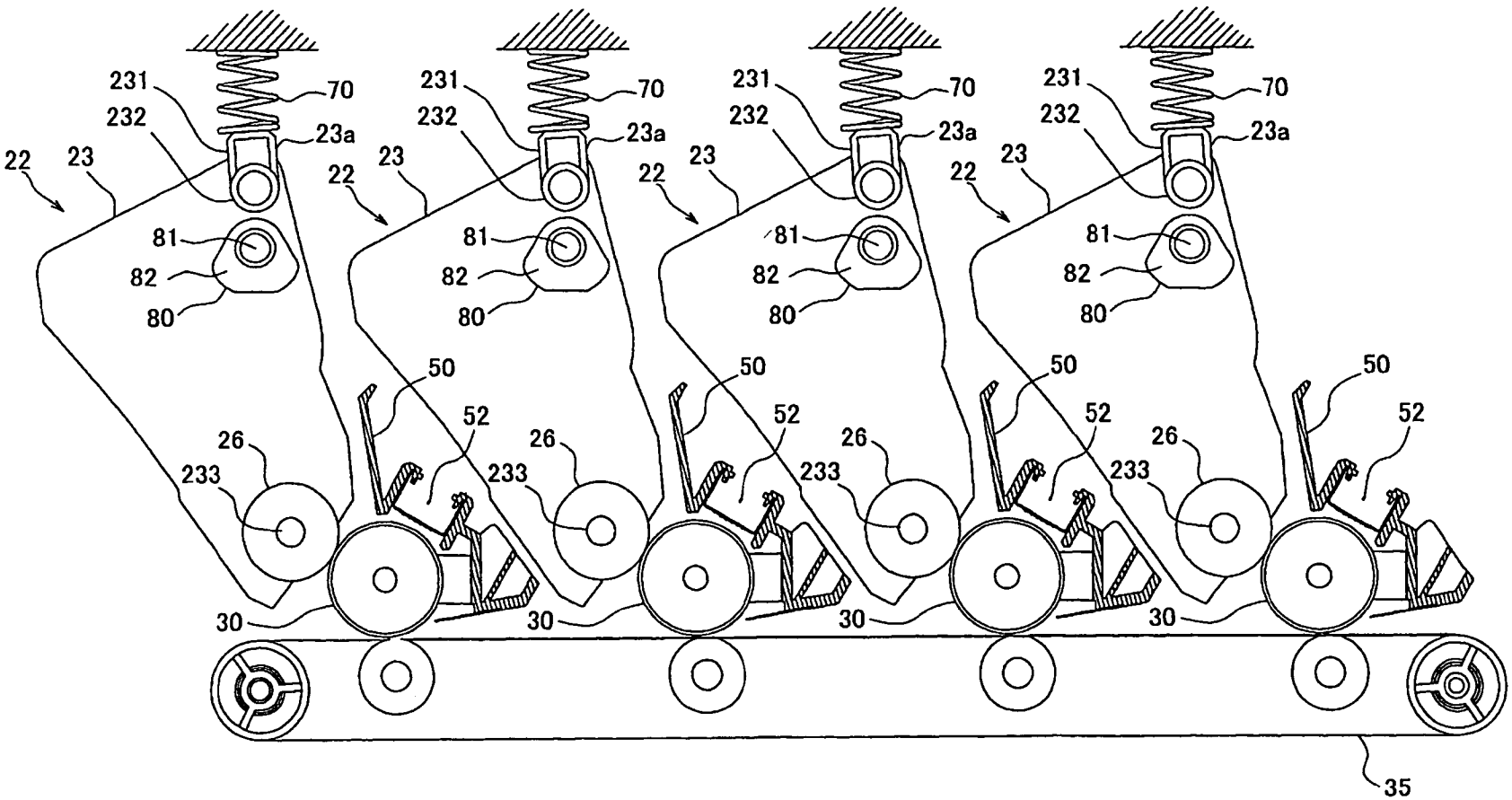
FIG. 6 is an enlarged view of part of the side cross-sectional view in FIG. 1 around the developing unit 22 and a developing roller 26 illustrating how a pressing member 70 presses against the developing unit 22.
Figure 7:
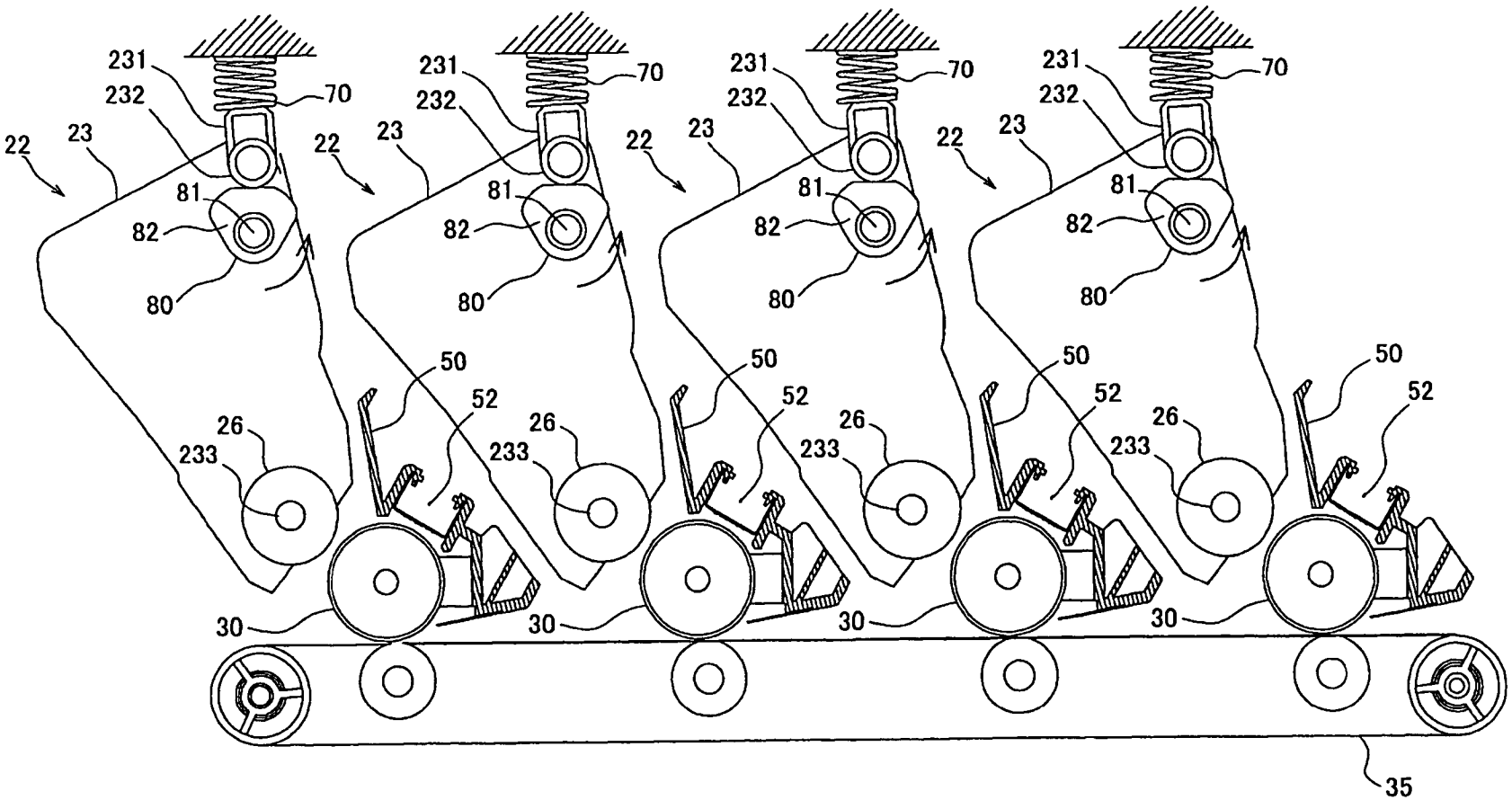
FIG. 7 is an enlarged view of part of the side cross-sectional view in FIG. 1 around the developing unit 22 and a developing roller 26 illustrating how a separating member 80 separates the developing unit 22 from a photosensitive drum 30.

FIG. 3A is a side view and FIG. 3B a front view of the developing unit 22 according to the preferred embodiment. FIG. 4 is a perspective view of the frame 21 in which the developing unit 22 of the preferred embodiment is mounted. FIG. 5 is a side cross-sectional view showing the general structure of the laser printer 1 according to the preferred embodiment when the developing unit 22 is mounted in the frame 21. FIG. 6 illustrates pressing members 70 that push against the developing units 22. FIG. 7 illustrates separating members 80 for displacing the developing units 22 in a direction away from the photosensitive drums 30.

As shown in FIG. 3B, the developing unit 22 employed in the laser printer 1 of the preferred embodiment includes the box-shaped case 23, and the toner-accommodating chamber 24 formed in the top section of the case 23 and filled with toner of the respective color. An elongated opening is formed in the lower side of the case 23, and the developing roller 26 is disposed in this opening.

As shown in FIG. 3A, the case 23 has end faces 23*a* formed at both axial ends of the developing roller 26 (see FIG. 3B) within planes that are substantially orthogonal to the axial direction (indicated by DX in FIG. 3B) of the developing roller 26. A pair of protrusions 231 and a pair of protrusions 232 are formed on the upper portions of the end faces 23*a* provided at both sides of the case 23. As shown in FIG. 3B, the protrusions 231 protrude outward from the end faces 23*a* in a direction parallel to the axis of the developing roller 26. The protrusions 232 protrude farther outward than the ends of the protrusions 231. As shown in FIG. 3A, the protrusions 231 and protrusions 232 are formed at the corners of the case 23. As shown in FIG. 3B, a pair of guiding protrusions 233 are provided on the end faces 23*a* near the front ends thereof and protrude outward in a direction parallel to the axis of the developing roller 26.

When the top cover 6 is opened, as shown in FIG. 2, the image-forming unit 20 accommodated in the main casing 2 can be pulled upward out of the main casing 2 in the preferred embodiment. As described above, the image-forming unit 20 includes the frame 21 that can be disassembled into four blocks 21*a*. As shown in FIG. 4, each block 21*a* includes one of the photosensitive drums 30 and chargers 50, as well as one of the cleaning brushes 33 (see FIG. 1) and the like. Each block 21*a* also includes a pair of mounting plates 21*b* extending upward from each axial end of the photosensitive drum 30. A guiding groove 21*c* for guiding the developing unit 22 is formed in the inner surface of each mounting plate 21*b* at opposing positions. The guiding grooves 21*c* function to guide the developing unit 22 mounted in the frame 21 until the developing roller 26 is in contact with the photosensitive drum 30. More specifically, the developing unit 22 is guided by the guiding protrusions 233 formed on the end faces of the developing unit 22 that slide within the guiding grooves 21*c*.

As shown in FIG. 6, the laser printer 1 also includes pressing members 70 provided in the main casing 2 for pressing the respective protrusions 231. The pressing members 70 are coil springs disposed in the main casing 2 at positions above and opposing each of the protrusions 231 of the developing units 22 when the image-forming unit 20 is accommodated in the main casing 2. The pressing members 70 push the respective developing units 22 so that the developing rollers 26 are pressed against the photosensitive drums 30.

As shown in FIG. 7, the laser printer 1 of the preferred embodiment also includes separating members 80 for moving the image-forming unit 20 accommodated in the main casing 2 in a direction that separates the developing rollers 26 from the photosensitive drums 30. The separating member 80 is configured of a separating piece 82 provided on an end of a rotational shaft 81. The separating piece 82 is mounted on the rotational shaft 81 in an eccentric position to the rotational center of the rotational shaft 81. The rotational shaft 81 is parallel to the rotational center of the developing roller 26, and the separating piece 82 is positioned beneath the protrusion 232. The separating member 80 separates from the protrusion 232 when the edge of the separating piece 82 having the shortest distance to the rotational shaft 81 opposes the protrusion 232, and pushes up the protrusion 232 against the urging force of the pressing member 70 when the edge of the separating piece 82 having the longest distance from the rotational shaft 81 opposes the protrusion 232.

Next, the effects of using the laser printer 1 having the construction described above will be described.

The cases 23 in the laser printer 1 have a high stiffness with respect to a force applied along the end face 23*a*. Further, the protrusions 231 and protrusions 232 are provided on the upper ends of the end faces 23*a* in the laser printer 1 of the preferred embodiment. Therefore, instead of pressing the case 23 as in the conventional laser printers, the laser printer 1 of the preferred embodiment can apply pressing and separating forces via the protrusions 231 and protrusions 232 without directly applying a force to the case 23 for separating the developing roller 26 from the photosensitive drum 30. Hence, since the pressing force and separating force are not applied to the case 23 at single points, it is unnecessary to increase the stiffness of the case 23. Moreover, it is unnecessary to increase the thickness of the case 23 since the pressing and separating forces are applied to the case 23 along the end faces 23*a*, which are the stiffest portions of the case 23.

Further, by forming the protrusions 232 farther outside than the protrusions 231 and at positions offset from the protrusions 231, opposing forces are not repeatedly applied to the same areas of the case 23. Therefore, the developing units in the laser printer 1 of the preferred embodiment can be formed without reinforcing the areas at which the protrusions 231 and protrusions 232 are provided, unlike the conventional developing units.

While the invention has been described in detail with reference to specific embodiments thereof, it would be apparent to those skilled in the art that many modifications and variations may be made therein without departing from the spirit of the invention, the scope of which is defined by the attached claims.

For example, the operating parts corresponding to the protrusions 231 that are operated by the pressing means need not be provided on the end faces 23*a* of the case 23 to achieve the effects described above.

Figure 8B:
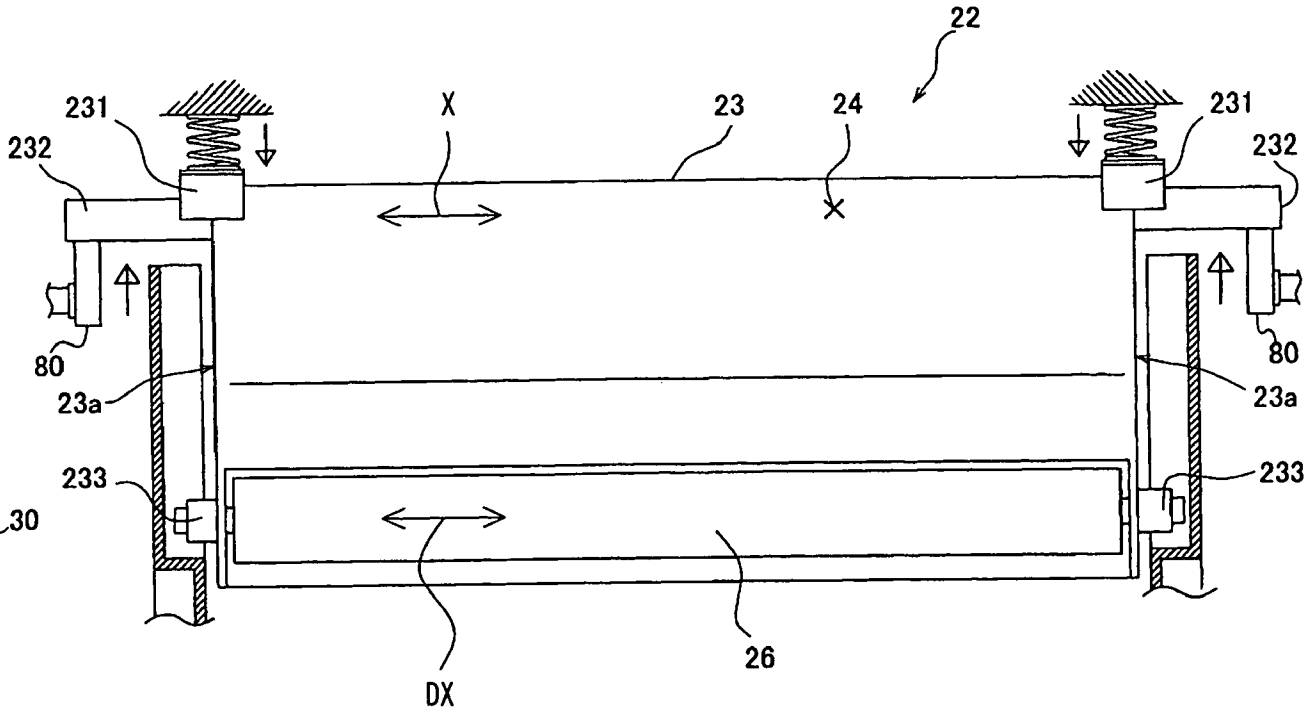
FIG. 8A is a side view and FIG. 8B a front view illustrating a variation of the developing unit in the preferred embodiment.
Figure 8A:
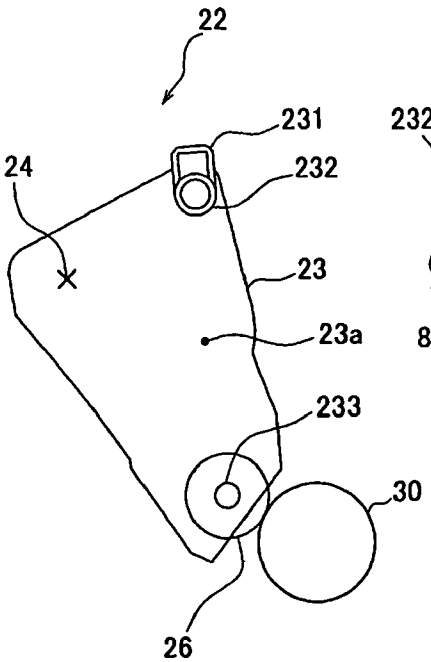

Specifically, as shown in FIG. 8, the protrusions 232 are preferably provided on the outside of the frame 21 on either side of the mounting plates 21*b* protruding outward in a direction parallel to the axis (indicated by DX in FIG. 8) of the developing roller 26. However, the protrusions 231 should be disposed inside of the protrusions 232 near the end faces 23*a* and along the axis of the protrusions 232. Here, "near the end faces 23*a*" should suggest that a portion of the protrusions 231 overlaps the surface of the end faces 23*a*. This construction can obtain the same effects as the preferred embodiment described above.

While the laser printer 1 of the preferred embodiment described above has horizontally juxtaposed developing units 22, the pressing members 70 and separating members 80 of the preferred embodiment may also be provided in a laser printer having vertically juxtaposed developing units 22. In such a case, the pressing members 70 push the protrusions 231 of the developing units 22 so that the developing rollers 26 are pressed against the photosensitive drums 30, while the separating members 80 push the protrusions 232 of the developing units 22 in the opposite direction so that the developing rollers 26 separate from the photosensitive drums 30.

While the invention has been described in detail with reference to the above embodiments thereof, it would be apparent to those skilled in the art that various changes and modifications may be made therein without departing from the spirit of the invention.

What is claimed is:

1. An image-forming device comprising:

an image-carrying member having a surface on which electrostatic latent images are formable;

a developer-carrying member configured to supply developer to the image-carrying member to develop the electrostatic latent image into a visible image, the developer-carrying member extending in an axial direction;

a casing having an inner space configured to accommodate developer, the developer-carrying member being supported in the casing and disposed in a position where developer accommodated in the inner space of the casing is conveyable to the image-carrying member;

a pressing member configured to press the casing in a direction causing the developer-carrying member to press against the image-carrying member; and a separating member configured to displace the casing in a direction that separates the developer-carrying member from the image-carrying member, wherein the casing comprises:

a pair of first protruding parts each having an end that protrudes outward along the axial direction of the developer-carrying member; and a pair of second protruding parts each having an end that protrudes farther outward than the corresponding end of the first protruding part, such that the first protruding parts serve as operating parts operated by the pressing member, and the second protruding parts serve as operating parts operated by the separating member.

2. The image-forming device according to claim 1, wherein the casing further comprises a pair of walls disposed in opposition, wherein each of the pair of first protruding parts and each of the pair of second protruding parts protrude from each of the pair of walls, and the pair of walls has corner portions at which the first protruding parts are formed.

3. The image-forming device according to claim 1, wherein the image-carrying member comprises a roller having an axis extending in a direction parallel to the axial direction, the developer-carrying member comprises a roller having an axis extending in the axial direction, wherein the image-carrying member and the developer-carrying member are held in contact with each other by the pressing member and are separated one from the other by the separating member.

4. An image-forming device comprising:

an image-carrying member having a surface on which electrostatic latent images are formable;

a developer-carrying member configured to supply developer to the image-carrying member to develop the electrostatic latent image into a visible image, the developer-carrying member extending in an axial direction;

a casing having an inner space configured to accommodate developer, the developer-carrying member being supported in the casing and disposed in a position where developer accommodated in the inner space of the casing is conveyable to the image-carrying member;

a pressing member configured to press the casing in a direction causing the developer-carrying member to press against the image-carrying member; and a separating member configured to displace the casing in a direction that separates the developer-carrying member from the image-carrying member, wherein the casing is formed with a pair of protruding parts each having an end that protrudes outward along the axial direction of the developer-carrying member, the pair of protruding parts serving as operating parts operated by the separating member, and the casing is further formed with a pair of walls disposed in opposition, wherein each of the pair of protruding parts protrude from each of the pair of walls and the pair of walls has corner portions at which the protruding parts are formed.

5. The image-forming device according to claim 4, wherein the image-carrying member comprises a roller having an axis extending in a direction parallel to the axial direction, the developer-carrying member comprises a roller having an axis extending in the axial direction, wherein the image-carrying member and the developer-carrying member are held in contact with each other by the pressing member and are separated one from the other by the separating member.

6. A developing unit comprising:

a developer-carrying member configured to supply developer to an image-carrying member on which electrostatic latent images are formable to develop the electrostatic latent image into a visible image, the developer-carrying member extending in an axial direction; and a casing having an inner space configured to accommodate developer, the developer-carrying member being supported in the casing and disposed in a position where developer accommodated in the inner space of the casing is conveyable to the image-carrying member, wherein the casing comprises:

a pair of first protruding parts each having an end that protrudes outward along the axial direction of the developer-carrying member; and a pair of second protruding parts each having an end that protrudes farther outward than the corresponding end of the first protruding part, such that the first protruding parts serve as operating parts operated by a pressing member, and the second protruding parts serve as operating parts operated by a separating member.

7. The developing unit according to claim 6, wherein the casing further comprises a pair of walls disposed in opposition, wherein each of the pair of first protruding parts and each of the pair of second protruding parts protrude from each of the pair of walls, and the pair of walls has corner portions at which the first protruding parts are formed.

8. The developing unit according to claim 6, wherein the image-carrying member comprises a roller having an axis extending in a direction parallel to the axial direction, the developer-carrying member comprises a roller having an axis extending in the axial direction, wherein the image-carrying member and the developer-carrying member are held in contact with each other by the pressing member and are separated one from the other by the separating member.

9. A developing unit comprising:

a developer-carrying member configured to supply developer to an image-carrying member on which electrostatic latent images are formable to develop the electrostatic latent image into a visible image, the developer-carrying member extending in an axial direction; and a casing having an inner space configured to accommodate developer, the developer-carrying member being supported in the casing and disposed in a position where developer accommodated in the inner space of the casing is conveyable to the image-carrying member, wherein the casing is formed with a pair of protruding parts each having an end that protrudes outward along the axial direction of the developer-carrying member, the pair of protruding parts serving as operating parts operated by a separating member, and the casing is further formed with a pair of walls disposed in opposition, wherein each of the pair of protruding parts protrude from each of the pair of walls and the pair of walls has corner portions at which the protruding parts are formed.

10. The developer unit according to claim 9, wherein the image-carrying member comprises a roller having an axis extending in a direction parallel to the axial direction, the developer-carrying member comprises a roller having an axis extending in the axial direction, wherein the image-carrying member and the developer-carrying member are held in contact with each other by a pressing member and are separated one from the other by the separating member.

* * * * *